US009885213B2

(12) United States Patent
Lyons

(10) Patent No.: US 9,885,213 B2
(45) Date of Patent: Feb. 6, 2018

(54) CUTTING STRUCTURES, TOOLS FOR USE IN SUBTERRANEAN BOREHOLES INCLUDING CUTTING STRUCTURES AND RELATED METHODS

(71) Applicant: Baker Hughes Incorporated, Houston, TX (US)

(72) Inventor: Nicholas J. Lyons, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 15/238,425

(22) Filed: Aug. 16, 2016

(65) Prior Publication Data

US 2016/0356092 A1 Dec. 8, 2016

Related U.S. Application Data

(63) Continuation of application No. 13/826,832, filed on Mar. 14, 2013, now Pat. No. 9,493,991.

(60) Provisional application No. 61/618,950, filed on Apr. 2, 2012.

(51) Int. Cl.
*E21B 10/32* (2006.01)
*E21B 10/26* (2006.01)

(52) U.S. Cl.
CPC ..... *E21B 10/26* (2013.01); *E21B 10/32* (2013.01)

(58) Field of Classification Search
CPC ..... E21B 10/32; E21B 10/322; E21B 10/325; E21B 10/327; E21B 10/567
USPC ..... 175/431, 269, 289
See application file for complete search history.

(56) References Cited

U.S. PATENT DOCUMENTS

| | | | |
|---|---|---|---|
| 1,548,578 | A | 8/1925 | Blanchard |
| 1,678,075 | A | 7/1928 | Phipps |
| 1,720,950 | A | 7/1929 | Edwards |
| 1,738,860 | A | 12/1929 | Wigle |
| 1,746,694 | A | 2/1930 | Clement |

(Continued)

FOREIGN PATENT DOCUMENTS

| | | | |
|---|---|---|---|
| DE | 2723785 | C3 | 1/1980 |
| EP | 246789 | A2 | 11/1987 |

(Continued)

OTHER PUBLICATIONS

International Search Report of the International Searching Authority for PCT/US2013/034880, dated Jul. 8, 2013, 3 pages.

(Continued)

*Primary Examiner* — Sunil Singh
(74) *Attorney, Agent, or Firm* — TraskBritt

(57) ABSTRACT

Cutting structures for use with downhole tools in subterranean boreholes include a blade, a plurality of primary cutting elements coupled to the blade, and at least one secondary element rotationally leading the plurality of primary cutting elements in a direction of intended rotation of the cutting structure. The at least one secondary element is coupled to the blade proximate a leading surface of the blade and comprises at least one of a rubbing surface and a cutting surface. An exposure of at least one primary cutting element of the plurality of primary cutting elements is greater than an exposure of the at least one secondary element. Downhole tools such as reamers include cutting structures. Methods of enlarging a subterranean borehole include reaming a borehole with cutting structures.

13 Claims, 9 Drawing Sheets

(56) References Cited

U.S. PATENT DOCUMENTS 1,773,307 A 8/1930 Grant
1,793,988 A 2/1931 Barkelew
1,812,044 A 6/1931 Grant
2,019,047 A 10/1935 Grant
2,069,482 A 2/1937 Seay
2,136,518 A 11/1938 Nixon
2,177,721 A 10/1939 Johnson et al.
2,214,320 A 9/1940 Brown
2,344,598 A 3/1944 Church
2,467,801 A 4/1949 Baker
2,532,418 A 12/1950 Page
2,624,412 A 1/1953 Ragan
2,638,988 A 5/1953 Williams
2,754,089 A 7/1956 Kammerer, Jr.
2,758,819 A 8/1956 Kammerer, Jr.
2,834,578 A 5/1958 Carr
2,874,784 A 2/1959 Baker, Jr. et al.
2,882,019 A 4/1959 Carr et al.
2,940,523 A 6/1960 Brown et al.
3,003,559 A 10/1961 Leathers et al.
3,050,122 A 8/1962 Huitt et al.
3,051,255 A 8/1962 Deely
3,083,765 A 4/1963 Kammerer
3,105,562 A 10/1963 Stone et al.
3,123,162 A 3/1964 Rowley
3,126,065 A 3/1964 Chadderson
3,136,364 A 6/1964 MMyers
3,171,502 A 3/1965 Kammerer
3,211,232 A 10/1965 Grimmer
3,224,507 A 12/1965 Cordary, Jr.
3,283,834 A 11/1966 Kammerer
3,289,760 A 12/1966 Kammerer
3,351,137 A 11/1967 Schultz et al.
3,365,010 A 1/1968 Howell et al.
3,370,657 A 2/1968 Antle
3,425,500 A 2/1969 Fuchs
3,433,313 A 3/1969 Brown
3,556,233 A 1/1971 Gilreath
4,141,421 A 2/1979 Gardner
4,231,437 A 11/1980 Swersky et al.
4,339,008 A 7/1982 Ford et al.
4,403,659 A 9/1983 Upchurch
4,458,761 A 7/1984 Van Vreeswyk
4,491,022 A 1/1985 de la Cruz
4,540,941 A 9/1985 Walkow
4,545,441 A 10/1985 Williamson
4,565,252 A 1/1986 Campbell et al.
4,589,504 A 5/1986 Simpson
4,629,011 A 12/1986 Reinhardt
4,635,738 A 1/1987 Schillinger et al.
4,660,657 A 4/1987 Furse et al.
4,690,229 A 9/1987 Raney
4,693,328 A 9/1987 Furse et al.
4,776,394 A 10/1988 Lynde et al.
4,842,083 A 6/1989 Raney
4,848,490 A 7/1989 Anderson
4,854,403 A 8/1989 Ostertag et al.
4,884,477 A 12/1989 Smith et al.
4,889,197 A 12/1989 Boe
4,893,678 A 1/1990 Stokley et al.
4,991,670 A 2/1991 Fuller et al.
5,070,952 A 12/1991 Neff
5,139,098 A 8/1992 Blake
5,211,241 A 5/1993 Mashaw et al.
5,224,558 A 7/1993 Lee
5,265,684 A 11/1993 Rosenhauch
5,293,945 A 3/1994 Rosenhauch et al.
5,305,833 A 4/1994 Collins
5,311,953 A 5/1994 Walker
5,318,131 A 6/1994 Baker
5,318,137 A 6/1994 Johnson et al.
5,318,138 A 6/1994 Dewey et al.
5,332,048 A 7/1994 Underwood et al.
5,343,963 A 9/1994 Bouldin et al.
5,361,859 A 11/1994 Tibbitts
5,368,114 A 11/1994 Tandberg et al.
5,375,662 A 12/1994 Echols, III et al.
5,402,856 A 4/1995 Warren et al.
5,425,423 A 6/1995 Dobson et al.
5,437,308 A 8/1995 Morin et al.
5,437,343 A 8/1995 Cooley et al.
5,443,129 A 8/1995 Bailey et al.
5,495,899 A 3/1996 Pastusek
5,531,281 A * 7/1996 Murdock ..... E21B 10/55 175/431
5,553,678 A 9/1996 Barr et al.
5,560,440 A 10/1996 Tibbitts et al.
5,595,252 A * 1/1997 O'Hanlon ..... E21B 10/43 175/393
5,605,198 A 2/1997 Tibbitts et al.
5,740,864 A 4/1998 de Hoedt et al.
5,758,723 A 6/1998 Saucier et al.
5,788,000 A 8/1998 Maury et al.
5,823,254 A 10/1998 Dobson et al.
5,836,406 A 11/1998 Schuh et al.
5,853,054 A 12/1998 McGarian et al.
5,862,870 A 1/1999 Hutchinson
5,887,655 A 3/1999 Haugen et al.
5,957,223 A 9/1999 Doster et al.
5,960,896 A 10/1999 Barr et al.
5,979,571 A 11/1999 Scott et al.
6,039,131 A 3/2000 Beaton
6,059,051 A 5/2000 Jewkes et al.
6,070,677 A 6/2000 Johnston, Jr.
RE36,817 E 8/2000 Pastusek
6,109,354 A 8/2000 Ringgenberg et al.
6,116,336 A 9/2000 Adkins et al.
6,131,675 A 10/2000 Anderson
6,173,795 B1 1/2001 McGarian et al.
6,189,631 B1 2/2001 Sheshtawy
6,202,770 B1 3/2001 Jurewicz et al.
6,213,226 B1 4/2001 Eppink et al.
6,220,375 B1 4/2001 Butcher et al.
6,227,312 B1 5/2001 Eppink et al.
6,244,364 B1 6/2001 Cariveau et al.
6,289,999 B1 9/2001 Dewey et al.
6,325,151 B1 12/2001 Vincent et al.
6,360,831 B1 3/2002 Akesson et al.
6,378,632 B1 4/2002 Dewey et al.
6,386,302 B1 5/2002 Beaton
6,450,271 B1 9/2002 Tibbitts et al.
6,488,104 B1 12/2002 Eppink et al.
6,494,272 B1 12/2002 Eppink et al.
6,609,580 B2 8/2003 Beaton
6,615,933 B1 9/2003 Eddison
6,651,756 B1 11/2003 Costo, Jr. et al.
6,655,478 B2 12/2003 Liang et al.
6,668,949 B1 12/2003 Rives
6,681,860 B1 1/2004 Yokley et al.
6,702,020 B2 3/2004 Zachman et al.
6,708,785 B1 3/2004 Russell et al.
6,732,817 B2 5/2004 Dewey et al.
6,880,650 B2 4/2005 Hoffmaster et al.
6,920,944 B2 7/2005 Eppink et al.
6,935,444 B2 8/2005 Lund et al.
6,991,046 B2 1/2006 Fielder et al.
7,017,677 B2 3/2006 Keshavan et al.
7,036,611 B2 5/2006 Radford et al.
7,036,614 B2 5/2006 Liang et al.
7,048,078 B2 5/2006 Dewey et al.
7,100,713 B2 9/2006 Tulloch
7,137,463 B2 11/2006 Beaton
7,237,628 B2 * 7/2007 Desai ..... E21B 10/55 175/406
7,258,177 B2 8/2007 Liang et al.
7,293,617 B2 11/2007 Beaton
7,308,937 B2 12/2007 Radford et al.
7,314,099 B2 1/2008 Dewey et al.
7,316,277 B2 1/2008 Jeffryes
7,350,601 B2 4/2008 Belnap et al.
7,370,712 B2 5/2008 Stout et al.
7,389,828 B2 6/2008 Ritter et al.
7,401,666 B2 7/2008 Fanuel et al.
7,407,525 B2 8/2008 Liang

(56) References Cited

U.S. PATENT DOCUMENTS 7,451,836 B2 11/2008 Hoffmaster et al.
7,451,837 B2 11/2008 Hoffmaster et al.
7,493,971 B2 2/2009 Nevlud et al.
7,493,973 B2 2/2009 Keshavan et al.
7,506,698 B2 3/2009 Eyre et al.
7,506,703 B2 3/2009 Campbell et al.
7,513,318 B2 4/2009 Underwood et al.
7,517,589 B2 4/2009 Eyre
7,549,485 B2 6/2009 Radford et al.
7,594,552 B2 9/2009 Radford et al.
7,597,158 B2 10/2009 Campbell et al.
7,608,333 B2 10/2009 Eyre
7,681,666 B2 3/2010 Radford et al.
7,681,671 B2 3/2010 Lim
7,699,120 B2 4/2010 Desai
7,703,556 B2 4/2010 Smith et al.
7,721,823 B2 5/2010 Radford
7,740,673 B2 6/2010 Eyre
7,754,333 B2 7/2010 Eyre et al.
7,757,787 B2 7/2010 Mackay et al.
7,757,791 B2 7/2010 Belnap et al.
7,762,355 B2 7/2010 McClain et al.
7,775,287 B2 8/2010 Duggan et al.
7,832,506 B2 11/2010 Liang et al.
7,861,802 B2 1/2011 Underwood et al.
7,882,905 B2 2/2011 Radford et al.
7,900,717 B2 3/2011 Radford et al.
7,900,718 B2 3/2011 Lyons
7,909,900 B2 3/2011 Ras
7,954,559 B2 6/2011 Paez
7,954,564 B2 6/2011 Makkar et al.
7,963,348 B2 6/2011 Laird et al.
7,997,354 B2 8/2011 Radford et al.
8,002,859 B2 8/2011 Griffo et al.
8,020,635 B2 9/2011 Radford
8,028,767 B2 10/2011 Radford et al.
8,028,771 B2 10/2011 Keshavan et al.
8,047,304 B2 11/2011 Radford
8,074,741 B2 12/2011 Meister
8,074,747 B2 12/2011 Radford et al.
8,147,572 B2 4/2012 Eyre et al.
8,181,722 B2 5/2012 Radford et al.
8,196,679 B2 6/2012 Radford
8,201,642 B2 6/2012 Radford et al.
8,205,687 B2 6/2012 Radford
8,205,689 B2 6/2012 Radford
8,215,418 B2 7/2012 Radford
8,230,951 B2 7/2012 Radford et al.
8,230,952 B2 7/2012 Schwefe et al.
8,235,144 B2 8/2012 Rasheed
8,297,381 B2 10/2012 Radford et al.
8,327,954 B2 12/2012 Desai
8,365,842 B2 2/2013 Hall et al.
8,365,843 B2 2/2013 Hall et al.
8,381,837 B2 2/2013 Laird et al.
8,443,875 B2 5/2013 Lee
8,453,763 B2 6/2013 Radford et al.
8,459,375 B2 6/2013 Radford
8,464,812 B2 6/2013 Radford et al.
8,485,282 B2 7/2013 Gentry
8,511,404 B2 8/2013 Rasheed
8,522,646 B2 9/2013 Laird et al.
8,528,668 B2 9/2013 Rasheed
8,550,188 B2 10/2013 Makkar et al.
8,555,983 B2 10/2013 Palacios
8,584,776 B2 11/2013 Radford et al.
8,613,331 B2 12/2013 Desai
8,657,038 B2 2/2014 Radford et al.
8,657,039 B2 2/2014 Radford et al.
8,727,041 B2 5/2014 Radford
8,746,371 B2 6/2014 Gentry
8,770,321 B2 7/2014 Makkar et al.
8,776,912 B2 7/2014 Makkar et al.
8,813,871 B2 8/2014 Radford et al.
8,820,439 B2 9/2014 Radford et al.
8,844,635 B2 9/2014 Oxford
8,881,833 B2 11/2014 Radford et al.
8,893,826 B2 11/2014 Desai
8,936,099 B2 1/2015 Hu
8,939,236 B2 1/2015 Radford et al.
8,960,333 B2 2/2015 Radford et al.
8,967,300 B2 3/2015 Dewey et al.
8,973,679 B2 3/2015 Dewey et al.
8,978,783 B2 3/2015 Cruickshank et al.
9,027,620 B2 5/2015 Cinget et al.
9,038,748 B2 5/2015 Radford et al.
9,038,749 B2 5/2015 Radford et al.
9,097,820 B2 8/2015 Rasheed
9,316,058 B2 4/2016 Bilen et al.
2002/0070052 A1 6/2002 Armell
2003/0029644 A1 2/2003 Hoffmaster et al.
2004/0119607 A1 6/2004 Davies et al.
2004/0134687 A1 7/2004 Radford et al.
2004/0222022 A1 11/2004 Nevlud et al.
2005/0145417 A1 7/2005 Radford et al.
2006/0118339 A1 6/2006 Takhaundinov et al.
2006/0144623 A1 7/2006 Ollerensaw et al.
2006/0207797 A1 9/2006 Dewey et al.
2006/0249307 A1 11/2006 Ritter et al.
2007/0089912 A1 4/2007 Eddison et al.
2007/0163808 A1 7/2007 Campbell et al.
2007/0205022 A1 9/2007 Treviranus et al.
2008/0102175 A1 5/2008 Jeon et al.
2008/0128169 A1 6/2008 Radford et al.
2008/0128175 A1 6/2008 Radford et al.
2009/0166094 A1 7/2009 Keshavan et al.
2009/0173015 A1 7/2009 Keshavan et al.
2010/0000800 A1* 1/2010 Chen ..... E21B 10/55 175/430
2010/0108394 A1 5/2010 Ollerenshaw et al.
2010/0186304 A1 7/2010 Burgess et al.
2010/0193248 A1 8/2010 Radford et al.
2010/0224414 A1* 9/2010 Radford ..... E21B 10/322 175/57
2010/0239483 A1 9/2010 Middlemiss
2010/0266816 A1 10/2010 Eyre
2010/0270086 A1 10/2010 Matthews et al.
2010/0276201 A1* 11/2010 Makkar ..... E21B 7/28 175/57
2010/0282511 A1 11/2010 Maranuk et al.
2010/0300764 A1 12/2010 Naidoo et al.
2011/0005841 A1 1/2011 Wood et al.
2011/0031034 A1 2/2011 DiGiovanni et al.
2011/0042149 A1 2/2011 Scott et al.
2011/0073330 A1 3/2011 Radford
2011/0073370 A1 3/2011 Gentry
2011/0073371 A1 3/2011 Radford
2011/0088950 A1 4/2011 Scott et al.
2011/0127044 A1 6/2011 Radford et al.
2011/0132666 A1 6/2011 DiGiovanni et al.
2011/0132667 A1 6/2011 Smallman et al.
2011/0155472 A1 6/2011 Lyons et al.
2011/0192651 A1 8/2011 Lyons et al.
2011/0203849 A1 8/2011 Radford et al.
2011/0232200 A1 9/2011 Griffo et al.
2011/0253459 A1 10/2011 Davies et al.
2011/0266060 A1 11/2011 Radford et al.
2011/0284233 A1 11/2011 Wu et al.
2011/0303466 A1 12/2011 DiGiovanni
2012/0031674 A1 2/2012 Lyons
2012/0037430 A1 2/2012 Smallman
2012/0048571 A1 3/2012 Radford et al.
2012/0080183 A1 4/2012 Radford et al.
2012/0080228 A1 4/2012 Radford et al.
2012/0080231 A1 4/2012 Radford et al.
2012/0111579 A1 5/2012 Radford et al.
2012/0205157 A1 8/2012 Radford et al.
2012/0222364 A1 9/2012 Lyons et al.
2012/0279785 A1 11/2012 Gavia et al.
2012/0298422 A1 11/2012 Oxford
2013/0256036 A1 10/2013 Lyons
2013/0264122 A1 10/2013 Radford et al.
2013/0333879 A1 12/2013 Rasheed
2014/0060933 A1 3/2014 Rasheed

(56) References Cited

U.S. PATENT DOCUMENTS

| | | | |
|---|---|---|---|
| 2014/0338981 | A1 | 11/2014 | Radford et al. |
| 2014/0353032 | A1 | 12/2014 | Radford et al. |
| 2014/0374123 | A1 | 12/2014 | Oxford |
| 2015/0060143 | A1 | 3/2015 | Radford et al. |

FOREIGN PATENT DOCUMENTS

| | | | |
|---|---|---|---|
| EP | 594420 | A1 | 12/1997 |
| EP | 594420 | B1 | 12/1997 |
| EP | 1036913 | A1 | 10/2002 |
| EP | 1044314 | A1 | 3/2005 |
| EP | 1614852 | A1 | 1/2006 |
| EP | 1402146 | B1 | 5/2007 |
| EP | 2327857 | B1 | 3/2014 |
| GB | 2328964 | A | 3/1999 |
| GB | 2344122 | A | 5/2000 |
| GB | 2344607 | A | 6/2000 |
| GB | 2319276 | B | 2/2001 |
| GB | 2353310 | A | 2/2001 |
| GB | 2344122 | B | 4/2003 |
| GB | 2393461 | B | 10/2006 |
| GB | 2426269 | B | 2/2007 |
| GB | 2438333 | B | 12/2008 |
| GB | 2441286 | B | 12/2008 |
| GB | 2437878 | B | 7/2009 |
| GB | 2446745 | B | 8/2009 |
| GB | 2460096 | A | 11/2009 |
| GB | 2420803 | B | 1/2010 |
| GB | 2465504 | A | 5/2010 |
| GB | 2465505 | A | 5/2010 |
| GB | 2449594 | B | 11/2010 |
| GB | 2455242 | B | 7/2011 |
| GB | 2476653 | A | 7/2011 |
| GB | 2470159 | B | 7/2012 |
| GB | 2473561 | B | 7/2012 |
| GB | 2479298 | B | 12/2013 |
| GB | 2521528 | A | 6/2015 |
| WO | 9928587 | A1 | 6/1999 |
| WO | 0031371 | A1 | 6/2000 |
| WO | 2007017651 | A1 | 2/2007 |
| WO | 2008150290 | A1 | 12/2008 |
| WO | 2009156552 | A1 | 12/2009 |
| WO | 2011080640 | A2 | 7/2011 |
| WO | 2011132166 | A2 | 10/2011 |
| WO | 2013166393 | A1 | 11/2013 |

OTHER PUBLICATIONS

International Written Opinion of the International Searching Authority for PCT/US2013/034880, dated Jul. 8, 2013, 7 pages.

International Preliminary Report on Patentability for PCT/US2013/034880, dated Oct. 7, 2014, 8 pages.

Radford et al., U.S. Appl. No. 60/399,531, filed Jul. 30, 2002, titled Expandable Reamer Apparatus for Enlarging Boreholes While Drilling and Method of Use.

Schlumberger, Case Study, Rhino XC Reamer Records 18 Activation Cycles in North Sea Underreaming Operation, www.slb.com/rhinoXC, (2012), 1 page.

Schlumberger, Case Study, After 300 Circulating Hours, Rhino XC Reamer Completes North Sea Reaming Dperation, www.slb.com/rhinoXC, (2012), 1 page.

Torvestad et al., Development of a New Advanced Multiple Activation System for Concentric Underreamers, IADC/SPE Drilling Conference and Exhibition (2012), 6 pages.

* cited by examiner

CUTTING STRUCTURES, TOOLS FOR USE IN SUBTERRANEAN BOREHOLES INCLUDING CUTTING STRUCTURES AND RELATED METHODS

CROSS-REFERENCE TO RELATED APPLICATIONS

This application is a continuation of U.S. patent application Ser. No. 13/826,832, filed Mar. 14, 2013, now U.S. Pat. No. 9,493,991, issued Nov. 15, 2016, which claims the benefit of U.S. Provisional Patent Application Ser. No. 61/618,950, filed Apr. 2, 2012, the disclosure of each of which is incorporated herein in its entirety by this reference.

TECHNICAL FIELD

Embodiments of the present disclosure relate generally to cutting structures for use in a subterranean borehole and, more particularly, to cutting structures for use with downhole tools for at least one of enlarging and drilling a subterranean borehole during a drilling operation (e.g., reamers or drill bits having a portion for enlarging a portion of the borehole) and to related methods.

BACKGROUND

Reamers are typically employed for enlarging subterranean boreholes. Conventionally, in drilling oil, gas, and geothermal wells, casing is installed and cemented to prevent the well bore walls from caving into the subterranean borehole while providing requisite shoring for subsequent drilling operation to achieve greater depths. Casing is also conventionally installed to isolate different formations, to prevent cross-flow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, which is assigned to the assignee of the present disclosure. A bi-center bit assembly employs two longitudinally superimposed bit sections with laterally offset axes, which, when rotated, produce an enlarged borehole diameter. An example of a bi-center bit is disclosed in U.S. Pat. No. 5,957,223, which is also assigned to the assignee of the present disclosure.

Another conventional approach used to enlarge a subterranean borehole includes employing an extended bottom-hole assembly with a pilot drill bit at the distal end thereof and a reamer assembly some distance above the pilot drill bit. This arrangement permits the use of any conventional rotary drill bit type (e.g., a rock bit or a drag bit), as the pilot bit and the extended nature of the assembly permit greater flexibility when passing through tight spots in the borehole as well as the opportunity to effectively stabilize the pilot drill bit so that the pilot drill bit and the following reamer will traverse the path intended for the borehole. This aspect of an extended bottom-hole assembly is particularly significant in directional drilling. The assignee of the present disclosure has, to this end, designed as reaming structures so called "reamer wings," which generally comprise a tubular body having a fishing neck with a threaded connection at the top thereof and a tong die surface at the bottom thereof, also with a threaded connection. U.S. Pat. Nos. RE36,817 and 5,495,899, both of which are assigned to the assignee of the present disclosure, disclose reaming structures including reamer wings. The upper midportion of the reamer wing tool includes one or more longitudinally extending blades projecting generally radially outwardly from the tubular body and PDC cutting elements are provided on the blades.

Expandable reamers may also be used to enlarge a subterranean borehole and may include blades that are pivotably or hingedly affixed to a tubular body and actuated by way of a piston disposed therein as disclosed by, for example, U.S. Pat. No. 5,402,856 to Warren. In addition, U.S. Pat. No. 6,360,831 to Akesson et al., discloses a conventional borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string, and, once the tool has passed beyond the end of the casing, the blades are extended so the bore diameter may be increased below the casing.

BRIEF SUMMARY

In some embodiments, the present disclosure includes a cutting structure for use with a downhole tool in a subterranean borehole. The cutting structure includes a blade, a plurality of primary cutting elements coupled to the blade, and at least one secondary element rotationally leading the plurality of primary cutting elements in a direction of intended rotation of the cutting structure. The at least one secondary element comprises at least one of a rubbing surface and a cutting surface and is coupled to the blade proximate a rotationally leading surface of the blade. An exposure of at least one primary cutting element of the plurality of primary cutting elements is greater than an exposure of the at least one secondary element.

In additional embodiments, the present disclosure includes a reamer for use in a subterranean borehole including a body and a plurality of blades coupled to the body. Each blade includes a plurality of primary cutting elements coupled to the blade and extending along the blade in a direction substantially parallel to a centerline of the blade and at least one secondary element comprising at least one of a rubbing surface and a cutting surface coupled to the blade proximate a rotationally leading surface of the blade and rotationally leading the plurality of primary cutting elements. An exposure of at least one primary cutting element of the plurality of primary cutting elements is greater than an exposure of the at least one secondary element.

In yet additional embodiments, the present disclosure includes methods for enlarging a subterranean borehole. The methods include engaging a subterranean borehole with at least one reamer blade coupled to a reamer, reaming a portion of the subterranean borehole with a plurality of primary cutting structures on the at least one blade, pivoting the reamer about the a plurality of primary cutting structures on the at least one blade and engaging the subterranean borehole with at least one secondary element on the at least one blade.

In yet additional embodiments, the present disclosure includes methods of forming downhole tools including cutting structures.

BRIEF DESCRIPTION OF THE DRAWINGS

While the specification concludes with claims particularly pointing out and distinctly claiming what are regarded as embodiments of the disclosure, various features and advantages of embodiments of the disclosure may be more readily ascertained from the following description of some embodiments of the disclosure, when read in conjunction with the accompanying drawings, in which:

DETAILED DESCRIPTION

Figure 1:
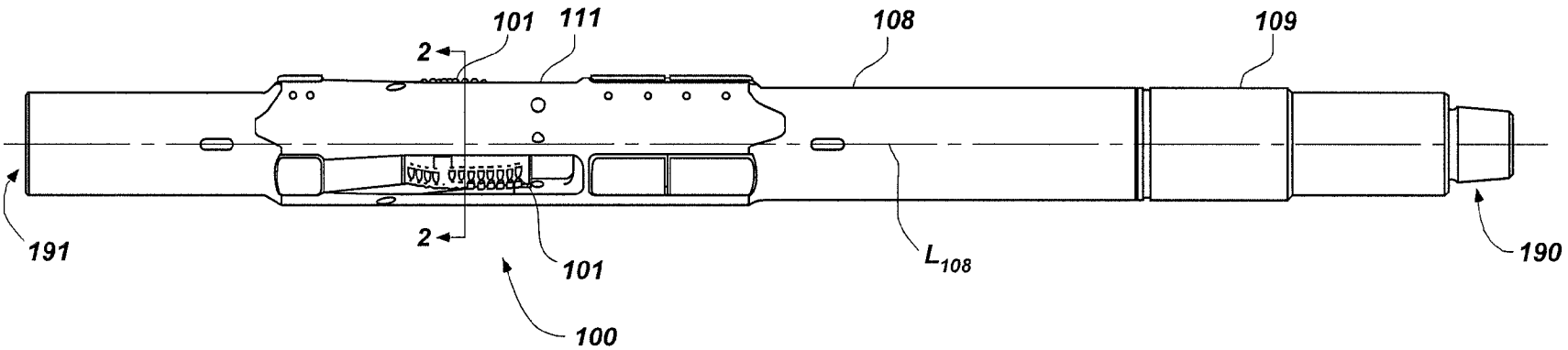
FIG. 1 is a side view of an embodiment of a reamer including a plurality of cutting structures in accordance with an embodiment of the present disclosure.

The illustrations presented herein are, in some instances, not actual views of any particular tool, apparatus, structure, element, or other feature of a downhole or earth-boring tool, but are merely idealized representations that are employed to describe embodiments of the present disclosure. Additionally, elements common between figures may retain the same numerical designation.

As disclosed herein, embodiments of cutting structures for use with downhole tools (e.g., a reaming tool) may include cutting elements (e.g., primary cutting elements) positioned on a portion of the downhole tool (e.g., an exterior surface or structure of the downhole tool that protrudes from a body of the downhole tool such as, for example, one or more blades). For example, the primary cutting elements may be positioned on surfaces of a downhole tool that at least partially extend only the length of the tool or along the length of the borehole in which the tool is to be utilized. The primary cutting elements may be positioned on the blades at a location trailing the rotationally leading surface (e.g., a leading edge) of the blade. For example, the primary cutting elements may be formed as a row extending along the length of the blade and may be positioned proximate a centerline of the blade (e.g., at the centerline or positioned between the centerline and a trailing surface such as, for example, a trailing edge of the blade). In some embodiments, one or more additional elements comprising a rubbing surface, a cutting surface, or combinations thereof may be coupled to the blade proximate the rotationally leading surface of the blade (e.g., elements to reduce wear of the blade proximate the leading surface). For example, at least one wear element (e.g., hardfacing, inserts, etc.), a second plurality of cutting elements (e.g., secondary cutting elements) or combinations thereof may be positioned proximate the rotationally leading surface of the blade. In other words, the second, additional elements may be positioned to rotationally lead the primary cutting elements. The primary cutting elements may also be positioned on the blade to have an exposure greater than an exposure of the additional elements.

Although embodiments of the present disclosure are depicted as being used and employed in a reamer such as an expandable reamer, persons of ordinary skill in the art will understand that the embodiments of the present disclosure may be employed in any downhole tool where use of cutting structures as disclosed herein, is desirable. For example, one or more cutting structures may be utilized with any type of tool or drill bit used at least partially for the enlargement of a wellbore in a subterranean formation (e.g., a reaming tool, a reamer, or a drill bit having a portion thereof for enlarging a borehole). Such reamers may include, for example, fixed reamers, expandable reamers, bicenter bits, and eccentric bits. In other embodiments, one or more cutting structures may be used with any type of tool or drill bit (i.e., downhole tools) for use in boreholes or wells in earth formations. For example, a downhole tool may employ one or more cutting structures used for drilling during the formation or enlargement of a wellbore in a subterranean formation and include, for example, earth-boring rotary drill bits, roller cone bits, core bits, mills, hybrid bits employing both fixed and rotatable cutting structures, and other drilling bits and tools as known in the art.

In some embodiments, the expandable reamer described herein may be similar to the expandable apparatus described in, for example, U.S. Patent Application Publication No. US 2008/0102175 A1, entitled "Expandable Reamers for Earth-Boring Applications," filed Dec. 3, 2007, now U.S. Pat. No. 7,900,717; U.S. patent application Ser. No. 12/570,464, entitled "Earth-Boring Tools having Expandable Members and Methods of Making and Using Such Earth-Boring Tools," filed Sep. 30, 2009, now U.S. Pat. No. 8,230,951; U.S. patent application Ser. No. 12/894,937, entitled "Earth-Boring Tools having Expandable Members and Related Methods," and filed Sep. 30, 2010; and United States Patent Application Publication No. US 2012/0111579 A1, entitled "Earth-Boring Tools having Expandable Members and Related Methods," and filed Nov. 8, 2011, the disclosure of each of which is incorporated herein in its entirety by this reference.

An embodiment of an expandable reamer apparatus 100 is shown in FIG. 1. The expandable reamer apparatus 100 may include a generally cylindrical tubular body 108 having a longitudinal axis $L_{108}$. The tubular body 108 of the expandable reamer apparatus 100 may have a distal end 190, a proximal end 191, and an outer surface 111. The distal end 190 of the tubular body 108 of the expandable reamer apparatus 100 may include a set of threads (e.g., a threaded male pin member) for connecting the distal end 190 to another section of a drill string (not shown) or another component of a bottom-hole assembly (BHA), such as, for example, a drill collar or collars carrying a pilot drill bit for drilling a well bore. In some embodiments, the expandable reamer apparatus 100 may include a lower sub 109 that connects to the lower box connection of the reamer body 108. Similarly, the proximal end 191 of the tubular body 108 of the expandable reamer apparatus 100 may include a set of threads (e.g., a threaded female box member) for connecting the proximal end 191 to another section of a drill string or another component of a bottom-hole assembly (BHA).

Figure 6:
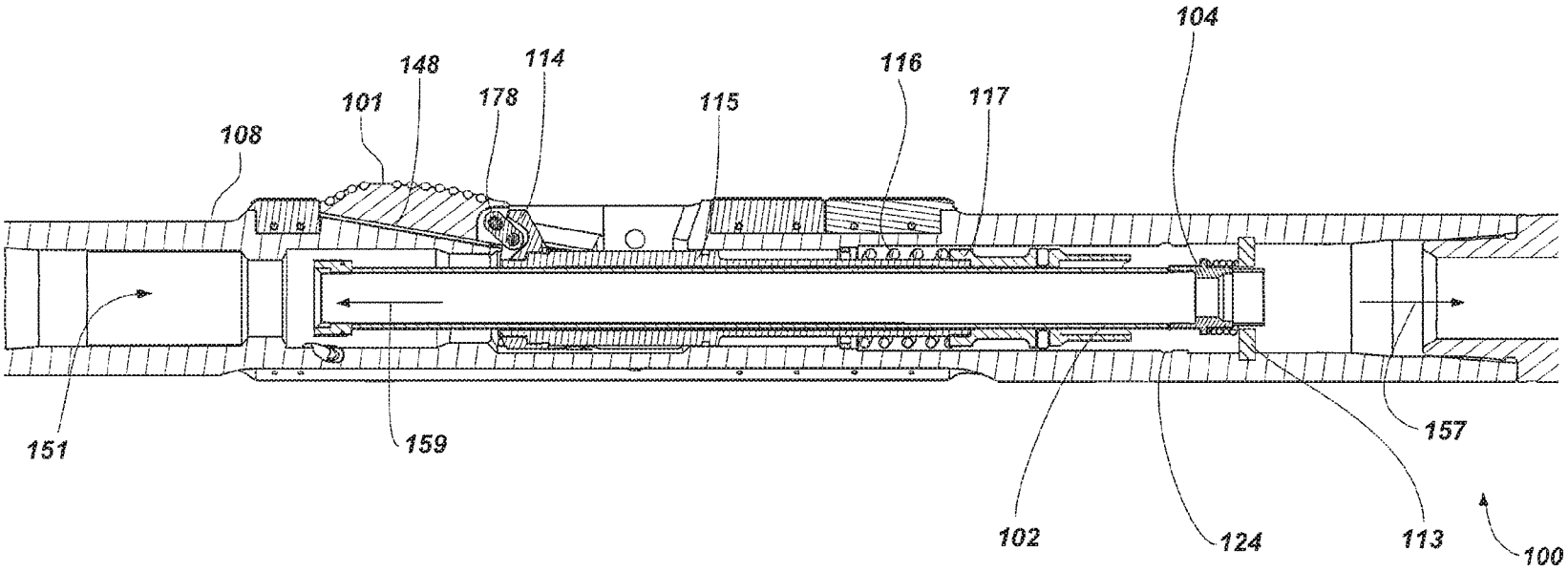
FIG. 6 shows a partial, longitudinal cross-sectional illustration of a reamer including the plurality of cutting structures in an expanded position.

The expandable reamer apparatus 100 may include one or more cutting structures 101 including a blade 106 (FIG. 2) and cutting elements as discussed below. For example, three sliding blades 106 are retained in circumferentially spaced relationship in the tubular body 108 as further described below and may be provided at a position along the expandable reamer apparatus 100 intermediate the first distal end 190 and the second proximal end 191. The blades 106 may be comprised of steel, tungsten carbide, a particle-matrix composite material (e.g., hard particles dispersed throughout a metal matrix material), or other suitable materials as known in the art. The cutting structures 101 are retained in an initial, retracted position within the tubular body 108 of the expandable reamer apparatus 100, as illustrated in FIG. 3, but may be moved responsive to application of hydraulic pressure into the extended position, as illustrated in FIG. 6, and returned to the retracted position when desired. The expandable reamer apparatus 100 may be configured such that the cutting structures 101 engage the walls of a subterranean formation surrounding a well bore in which the expandable reamer apparatus 100 is disposed to remove formation material when the cutting structures 101 are in the extended position, but are not operable to engage the walls of a subterranean formation within a well bore when the cutting structures 101 are in the retracted position. While the expandable reamer apparatus 100 includes three cutting structures 101, it is contemplated that one, two or more than three cutting structures may be utilized to advantage. Moreover, while the cutting structures 101 of expandable reamer apparatus 100 are symmetrically circumferentially positioned about the longitudinal axis $L_{108}$ along the tubular body 108, the cutting structures 101 may also be positioned circumferentially asymmetrically as well as asymmetrically about the longitudinal axis $L_{108}$. The expandable reamer apparatus 100 may also include a plurality of stabilizer pads to stabilize the tubular body 108 of expandable reamer apparatus 100 during drilling or reaming processes. For example, the expandable reamer apparatus 100 may include upper hard face pads, mid hard face pads, and lower hard face pads.

Figure 2:
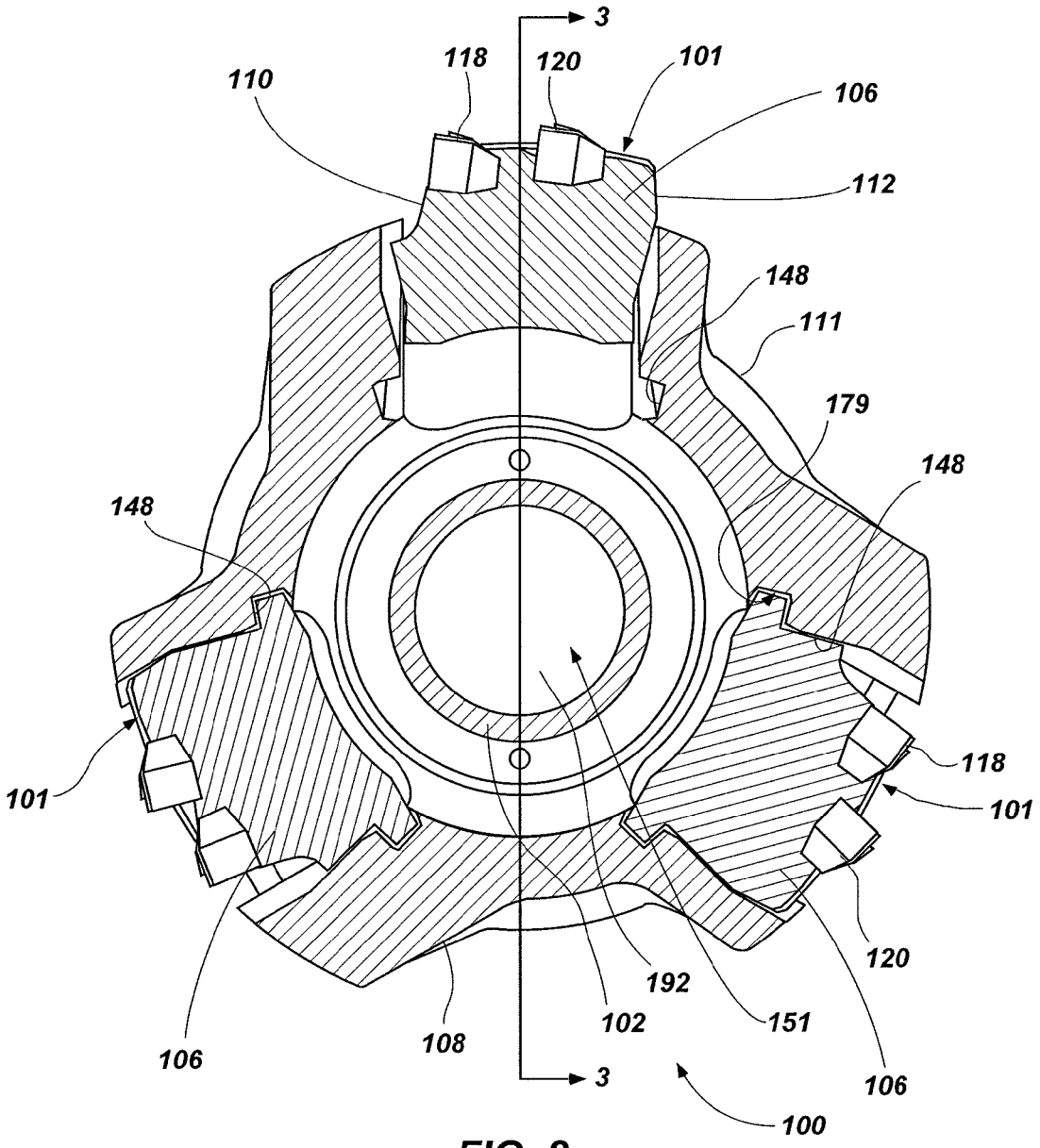
FIG. 2 shows a transverse cross-sectional view of the reamer including the plurality of cutting structures as indicated by section line 2-2 in FIG. 1.
Figure 3:
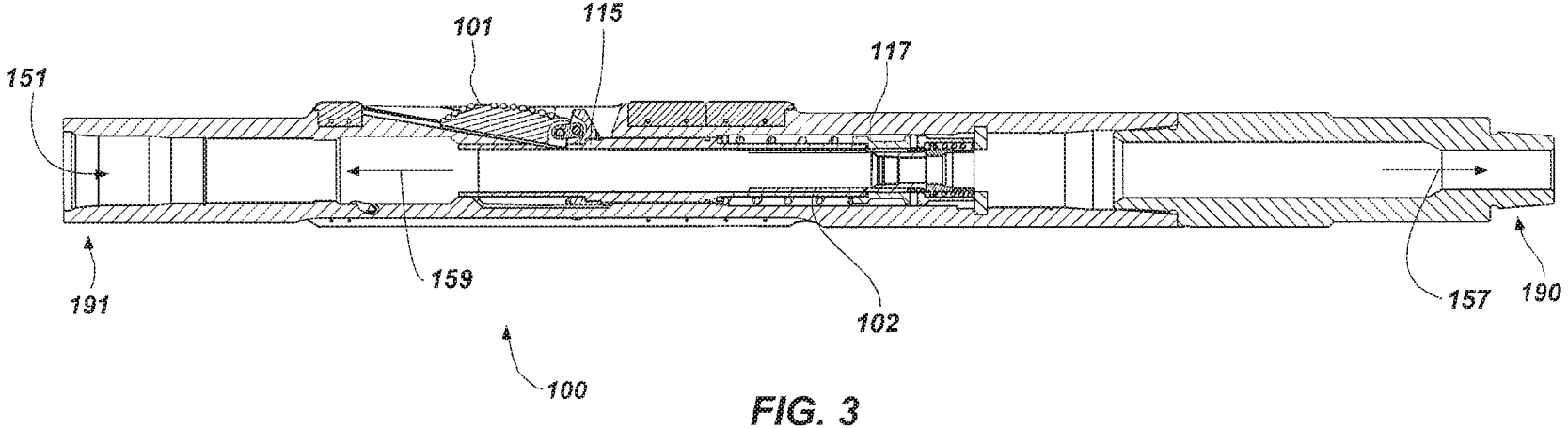
FIG. 3 shows a longitudinal cross-sectional view of the reamer including the plurality of cutting structures as indicated by section line 3-3 in FIG. 2.

FIG. 2 is a cross-sectional view of the expandable reamer apparatus 100 shown in FIG. 1, taken along section line 2-2 shown therein. As shown in FIG. 2, the elongated cylindrical wall of the tubular body 108 encloses a fluid passageway 192 that extends longitudinally through the tubular body 108. Fluid may travel through the fluid passageway 192 in a longitudinal bore 151 of the tubular body 108 (and a longitudinal bore of a sleeve member).

To better describe aspects of embodiments of the disclosure, in FIG. 2, one of cutting structures 101 is shown in the outward or extended position while the other cutting structures 101 are shown in the initial or retracted positions. In the retracted or recessed position, the cutting structures 101 of the expandable reamer apparatus 100 may be substantially disposed within the tubular body 108 of the expandable reamer apparatus 100. The cutting structures 101 may extend beyond the outer diameter of the tubular body 108 when in the extended position, for example, to engage the walls of a borehole in a reaming operation.

The three sliding blades 106 of the cutting structures 101 may be retained in three blade tracks 148 formed in the tubular body 108.

The cutting structures 101 each carry one or more rows of elements configured to engage with the wall of a subterranean borehole during downhole operations. For example, the cutting structures 101 may include a row of cutting elements (e.g., primary cutting elements 120) positioned on each blade 106 of the cutting structures 101. The primary cutting elements 120 are configured to engage material of a subterranean formation defining the wall of an open borehole when the cutting structures 101 are in an extended position. As above, the primary cutting elements 120 may be positioned on the blades 106 at a location trailing a rotationally leading surface 110 of the blade 106. For example, the primary cutting elements 120 may be formed as a row extending along the length of the blade 106 and may be positioned proximate a centerline (see, e.g., FIG. 7) of the blade 106 (e.g., at the centerline or positioned between the centerline and a trailing surface 112 of the blade 106).

One or more additional, secondary elements 118 forming a cutting surface, a rubbing surface, or combinations thereof may be positioned proximate the rotationally leading surface 110 of the blade 106. In other words, the secondary elements 118 may be positioned to rotationally lead the primary cutting elements 120. The secondary elements 118 may comprise at least one wear element (e.g., hardfacing, inserts, rubbing or bearing elements, etc.), a second plurality of cutting elements (e.g., secondary cutting elements) or combinations thereof.

The primary cutting elements 120 may be configured to be relatively more aggressive than the secondary elements 118. For example, the primary cutting elements 120 may have an exposure greater than an exposure of the secondary elements 118. In additional embodiments, the primary cutting elements 120 may have a back rake angle less than a back rake angle of the secondary elements 118. In such an embodiments, the relatively greater back rake angle of the secondary elements 118 may act to reduce the likelihood that the secondary element 118 will engage (e.g., cut) the formation, thereby, enabling the secondary elements 118 to move along (e.g., slide along) the formation, for example, while stabilizing the cutting structure 101, as the primary cutting elements 120 remove material (e.g., ream) the formation. In other embodiments, the primary cutting elements 120 may have an exposure greater than an exposure of the secondary elements 118 and may have a back rake angle greater than a back rake angle of the secondary elements 118. In yet other embodiments, the secondary elements 118 may have a larger chamfer or comprise cutting elements having relatively less aggressive or efficient cutting edge geometries as compared to the primary cutting elements 120.

In some embodiments, the secondary elements 118 and primary cutting elements 120 may be polycrystalline diamond compact (PDC) cutters or other cutting elements known in the art. In embodiments where the secondary elements 118 are configured to remove material from a subterranean borehole (e.g., where the secondary elements 118 comprise a cutting surface), the secondary elements 118 (e.g., secondary cutting elements) may remove material from the formation and act to protect a rotationally leading portion of the blades 106 from substantial wear as the blades 106 contact the subterranean formation.

In some embodiments, the secondary elements 118 may be shaped inserts (e.g., circular shaped inserts such as, for example, ovoids) formed from superabrasive materials (e.g., diamond-enhanced materials such as, for example, thermally stable product (TSP) inserts) and/or tungsten carbide materials, other shaped tungsten carbide and diamond-enhanced inserts (e.g., bricks or discs), or combinations thereof. In embodiments where the secondary elements 118 are not configured to primarily remove material from a subterranean borehole (e.g., where the secondary elements 118 are configured as a bearing or rubbing surface), the secondary elements 118 may act to protect a rotationally leading portion of the blades 106 from substantial wear as the blades 106 contact the subterranean formation.

In some embodiments, the secondary elements 118 may be configured as substantially chisel-shaped elements, chisel-shaped elements having one or more blunt surfaces, elements configured to have a plowing, gouging, and/or crushing cutting action, or combinations thereof.

Figure 10:
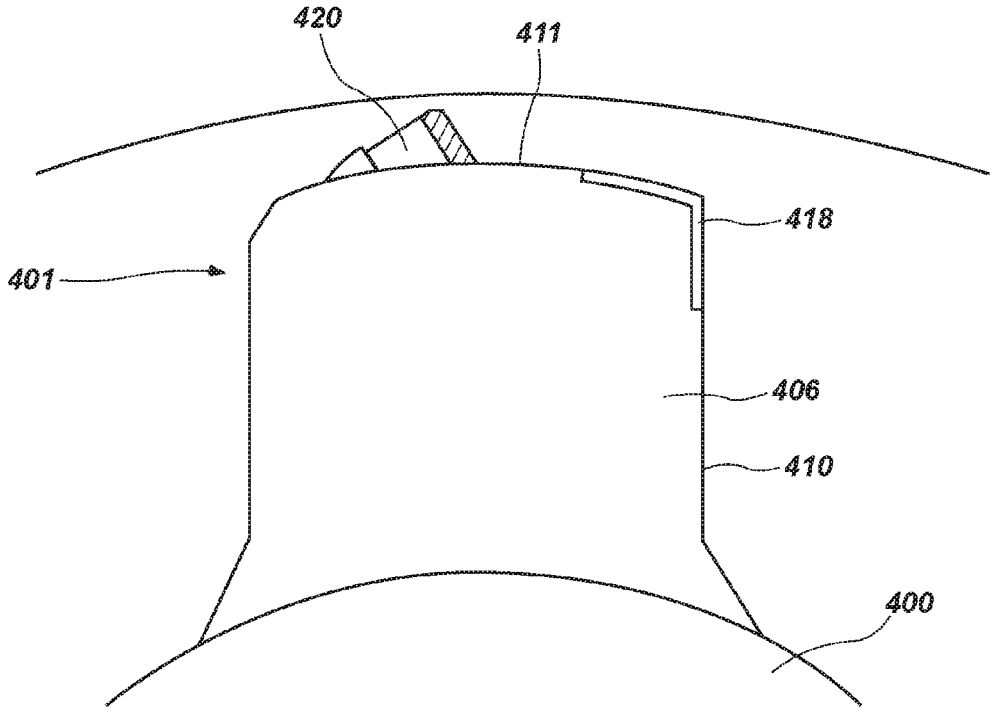
FIG. 10 shows a top view of a cutting structure coupled to a downhole tool such as a reamer in accordance with yet another embodiment of the present disclosure.

In some embodiments, the cutting structures 101 may include additional wear features such as, for example, hardfacing on portions of the blades 106 (e.g., at the rotationally leading surface 110 as shown in FIG. 10).

Figure 4:
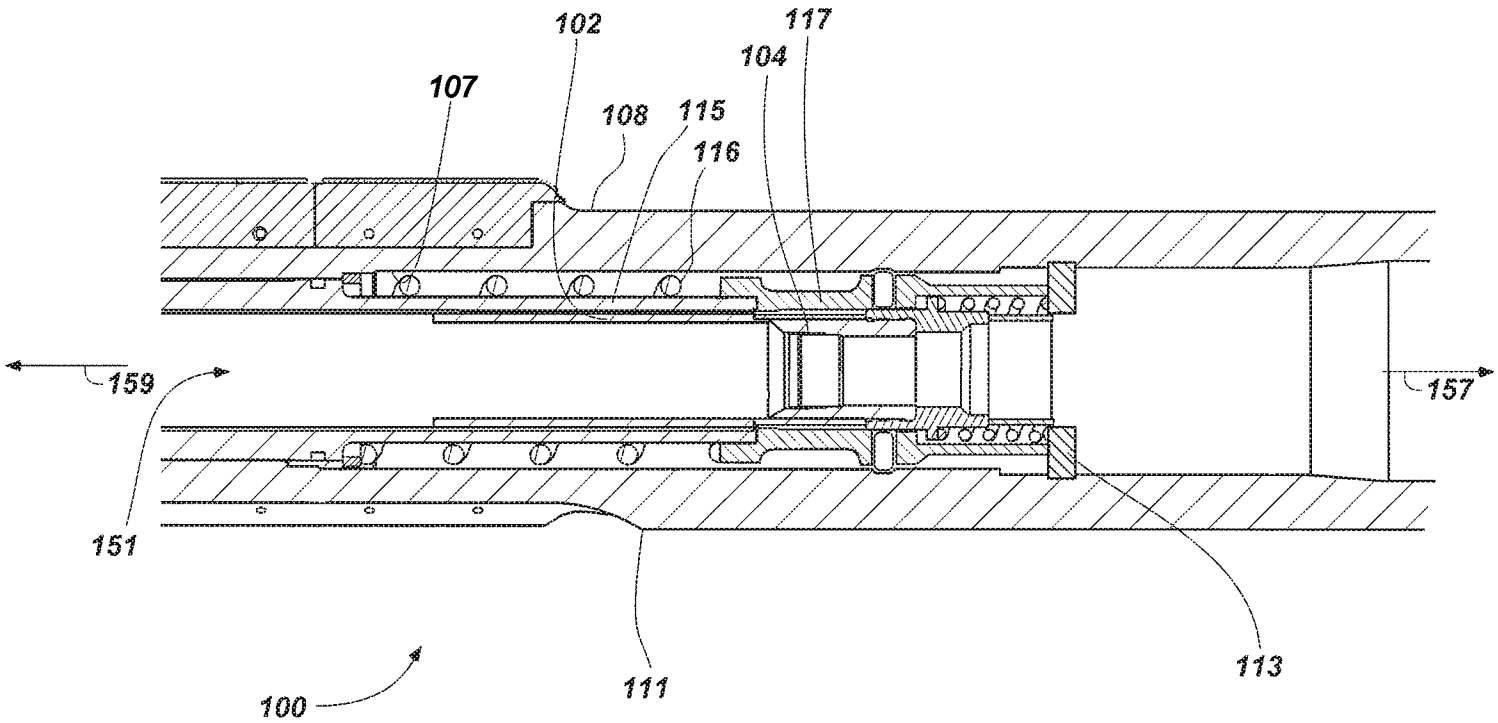
FIG. 4 shows an enlarged cross-sectional view of a downhole portion reamer including the plurality of cutting structures shown in FIG. 3.
Figure 5:
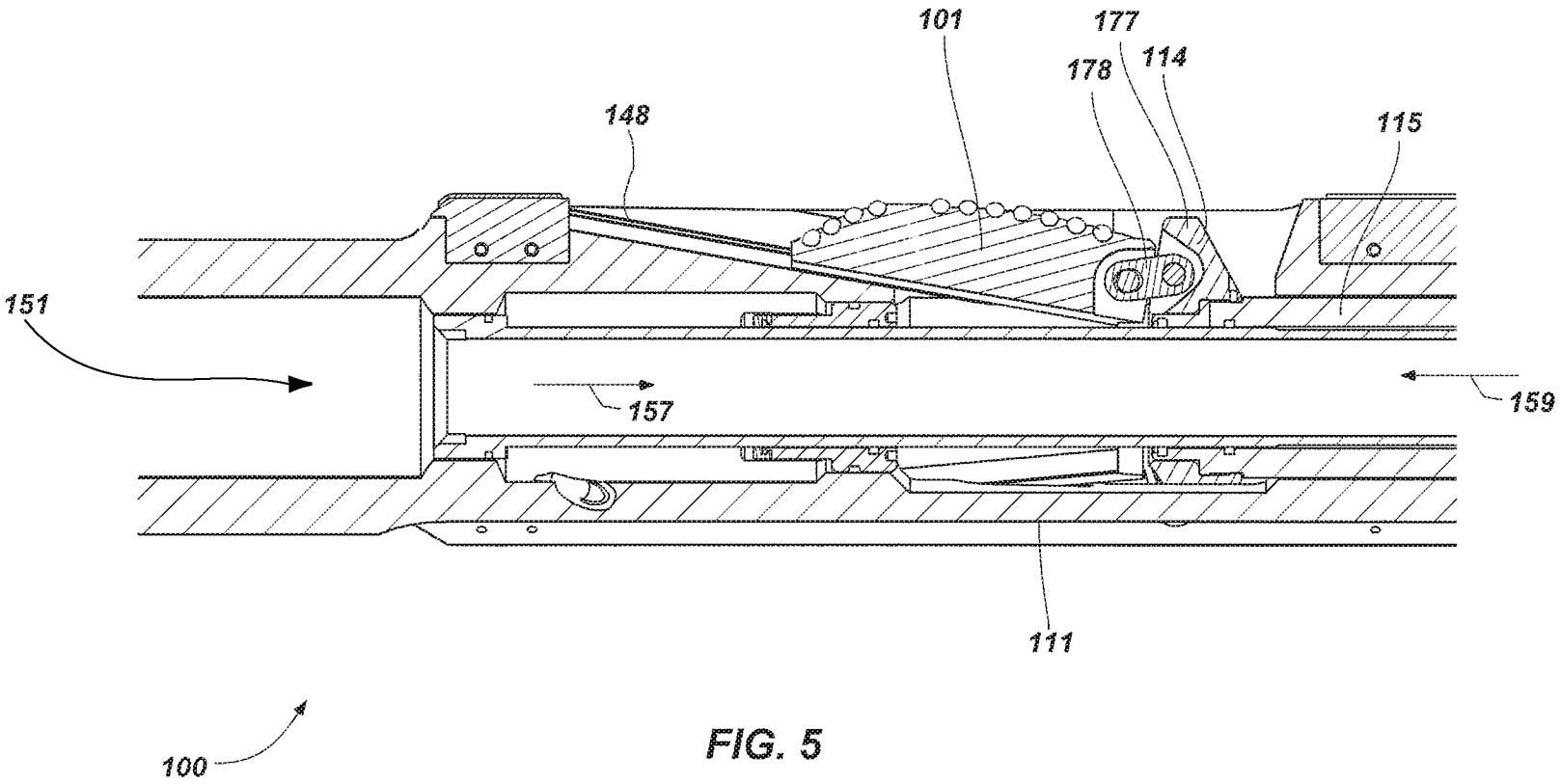
FIG. 5 shows an enlarged cross-sectional view of an uphole portion of reamer including the plurality of cutting structures shown in FIG. 3.

FIG. 3 shows a longitudinal cross-sectional view of the expandable reamer apparatus 100 as indicated by section line 3-3 in FIG. 2. The expandable reamer apparatus 100 may include an actuating feature, such as a push sleeve 115 coupled to extendable and retractable cutting structures 101. The actuating feature of the reamer apparatus 100 may also include a latch sleeve 117 coupled to the push sleeve 115. In some embodiments, the latch sleeve 117 may be formed as a portion of the push sleeve 115. The push sleeve 115 may be directly or indirectly coupled (e.g., by a linkage) to the one or more cutting structures 101 of the expandable reamer apparatus 100. As discussed below in further detail, the push sleeve 115 may move in an uphole direction 159 in order to transition the cutting structures 101 between the extended and retracted position. The cutting structures 101 of the expandable reamer apparatus 100 may be retained in a retracted position by a retaining feature such as a sleeve member (e.g., a traveling sleeve 102). As depicted in FIGS. 4 through 6, the length of the traveling sleeve 102 may be varied in different embodiments depending on the application.

As shown in FIG. 4, the expandable reamer apparatus 100 may include a traveling sleeve 102, which is movable from a first, initial position, which is shown in FIG. 4, in a downhole direction 157 to a second position (e.g., a triggered position) shown in FIG. 6. The traveling sleeve 102 may be at least partially received within a portion of the actuating feature of the reamer apparatus 100 (e.g., one or more of a portion of the push sleeve 115 and a portion of the latch sleeve 117). For example, the push sleeve 115 and the latch sleeve 117 may be cylindrically retained between the traveling sleeve 102 and the inner surface of the tubular body 108 of the expandable reamer apparatus 100.

The push sleeve 115 may be retained in the initial position by the traveling sleeve 102. For example, a portion of the traveling sleeve 102 may act to secure a portion of the push sleeve 115 (or another component attached thereto such as, for example, the latch sleeve 117) to a portion of an inner wall 107 of the tubular body 108 of the expandable reamer apparatus 100.

Referring still to FIG. 4, when the traveling sleeve 102 is in the initial position, the hydraulic pressure may act on the push sleeve 115, which is coupled the latch sleeve 117, between an outer surface of the traveling sleeve 102 and an inner surface of the tubular body 108. With or without hydraulic pressure, when the expandable reamer apparatus 100 is in the initial position, the push sleeve 115 is prevented from moving (e.g., in the uphole direction 159) by the latch sleeve 117.

After the traveling sleeve 102 travels sufficiently far enough from the initial position in the downhole direction 157 (e.g., to a triggered position) to enable the latch sleeve 117 to be disengaged from the tubular body 108, the latch sleeve 117, which is coupled to the push sleeve 115, may both move in the uphole direction 159. In order for the push sleeve 115 to move in the uphole direction 159, the differential pressure between the longitudinal bore 151 and the outer surface 111 of the tubular body 108 caused by the hydraulic fluid flow must be sufficient to overcome the restoring force or bias of a spring 116.

FIG. 5 shows an enlarged cross-sectional view of an uphole portion of an embodiment of an expandable reamer apparatus 100. As shown in FIG. 5, the push sleeve 115 includes, at its proximal end, a yoke 114 coupled to the push sleeve 115. The yoke 114 includes three arms 177, each arm 177 being coupled to one of the cutting structures 101 by a pinned linkage 178. The pinned linkage 178 enables the cutting structures 101 to rotationally transition about the arms 177 of the yoke 114 as the actuating means (e.g., the push sleeve 115, the yoke 114, and the linkage 178) transitions the cutting structures 101 between the extended and retracted positions.

Referring now to FIGS. 4 and 6, the expandable reaming apparatus 100 is now described in terms of its operational aspects. Before "triggering" the expandable reamer apparatus 100 to the expanded position, the expandable reamer apparatus 100 is maintained in an initial, retracted position as shown in FIG. 4. While the traveling sleeve 102 is in the initial position, the cutting structure actuating feature (e.g., the push sleeve 115) is prevented from actuating the cutting structures 101. When it is desired to trigger the expandable reamer apparatus 100, the traveling sleeve 102 is moved in the downhole direction 157 to release the latch sleeve 117. For example, the rate of flow of drilling fluid through the reamer apparatus 100 is increased to increase the hydraulic pressure at a constricted portion 104 of the traveling sleeve 102 and to exert a force (e.g., a force due to a pressure differential) against the traveling sleeve 102 and translate the traveling sleeve 102 in the downhole direction 157. In additional embodiments, other methods may be used to constrict fluid flow through the traveling sleeve 102 in order to move the traveling sleeve 102 in the downhole direction 157. For example, an obstruction may be selectively disposed within the traveling sleeve 102 to at least partially occlude fluid from flowing therethrough in order to apply a force in the downhole direction 157 to the traveling sleeve 102.

As shown in FIG. 6, the traveling sleeve 102 may travel sufficiently far enough from the initial position in the downhole direction 157 to enable the latch sleeve 117 to be disengaged from the groove 124 of the tubular body 108. The latch sleeve 117, coupled to the pressure-activated push sleeve 115, may move in the uphole direction 159 under fluid pressure influence (e.g., from fluid supplied through orifices in one or more of the latch sleeve 117, the traveling sleeve 102, and a ring 113). As the fluid pressure is increased by the increased fluid flow, the biasing force of the spring 116 is overcome enabling the push sleeve 115 to move in the uphole direction 159. Movement of the push sleeve 115 in the uphole direction 159 may move the yoke 114 and the cutting structures 101 in the uphole direction 159. In moving in the uphole direction 159, the cutting structures 101 each follow a ramp or track 148 to which they are mounted (e.g., via a type of modified square dovetail groove 179 (FIG. 2)).

Whenever the flow rate of the drilling fluid passing through the traveling sleeve 102 is decreased below a selected flow rate value, the traveling sleeve 102 may be returned to the initial position shown in FIG. 4 under the biasing force of spring 116. As the traveling sleeve 102 returns to the initial position, the latch sleeve 117 may return to the initial position and the traveling sleeve 102 may again secure the latch sleeve 117 to the tubular body 108. The push sleeve 115, the yoke 114, the cutting structures 101, and the latch sleeve 117 may also be returned to their initial or retracted positions under the force of the spring 116.

Whenever the flow rate of the drilling fluid passing through traveling sleeve 102 is elevated to or beyond a selected flow rate value, the traveling sleeve 102 may again move in the downhole direction 157 releasing the latch sleeve 117 as shown in FIG. 6. The push sleeve 115 with the yoke 114 and cutting structures 101 may then move upward with the cutting structures 101 following the tracks 148 to again ream the prescribed larger diameter in a borehole. In this manner, the expandable reamer apparatus 100 may move the cutting structures 101 between the retracted position and the expanded position in a repetitive manner (e.g., an unlimited amount of times).

Figure 7:
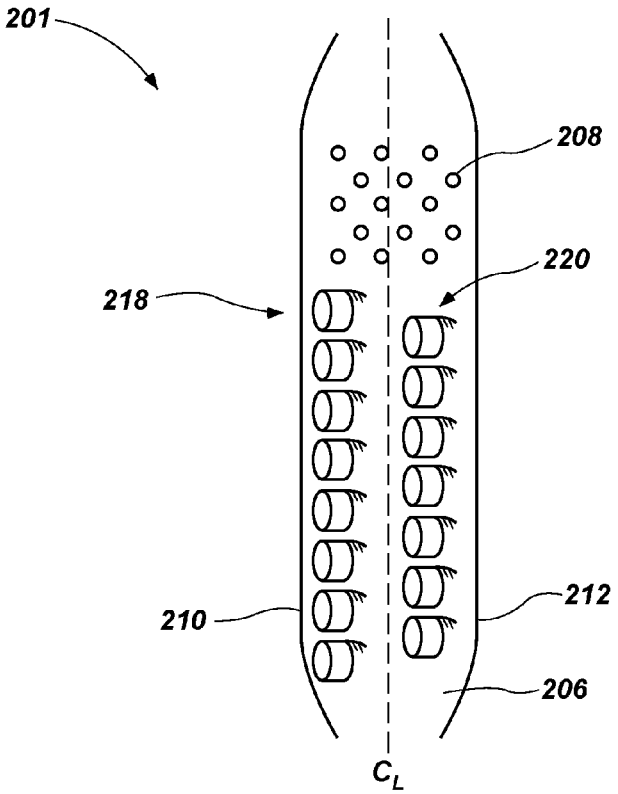
FIG. 7 shows a partial, front view of a cutting structure in accordance with another embodiment of the present disclosure.

FIG. 7 shows a partial, front view of a cutting structure 201 including multiple rows (e.g., two) of elements (e.g., cutting elements). In some embodiments, cutting structure 201 may be somewhat similar to the cutting structures 101 discussed above. As shown in FIG. 7, the cutting structure 201 including a plurality of secondary elements (e.g., secondary cutting elements 218) and a plurality of cutting elements (e.g., primary cutting elements 220) may be formed on a portion of a downhole tool. For example, the primary cutting elements 220 and secondary elements 218 may be formed on a portion of the downhole tool that protrudes (e.g., permanently or selectively) from another portion of the downhole tool (e.g., a blade 206 of a reamer such as, for example, and the expandable reamer 100 discussed above). As noted above, in some embodiments, the secondary elements 218 may be formed as bearing or rubbing elements (i.e., configured to move along a surface of the subterranean formation without substantially removing material therefrom) instead of cutting elements.

Cutting elements 220 extend along the blade 206 in a position rotationally trailing cutting elements 218. In other words, cutting elements 220 may trail cutting elements 218 in a direction of indented rotation of the cutting structure 201 during a downhole operation. For example, cutting elements 218 may positioned proximate (e.g., at) the rotationally leading surface of the blade 206. The cutting elements 220 may be positioned proximate to (e.g., at or rotationally trailing) a centerline $C_L$ of the blade 206. For example, the cutting elements 220 may be positioned on the blade 206 between the centerline $C_L$ of the blade 206 and a trailing surface 212 of the blade 206. The cutting elements 220 may extend along the length of the blade 206 (e.g., in direction substantially parallel to the centerline $C_L$).

In some embodiments, the cutting structure 201 may include one or more inserts 208 positioned proximate the cutting elements 218, 220 (e.g., on an uphole portion of the blade 206) that are configured to provide a rubbing surface that may contact the formation during downhole operation.

Figure 8:
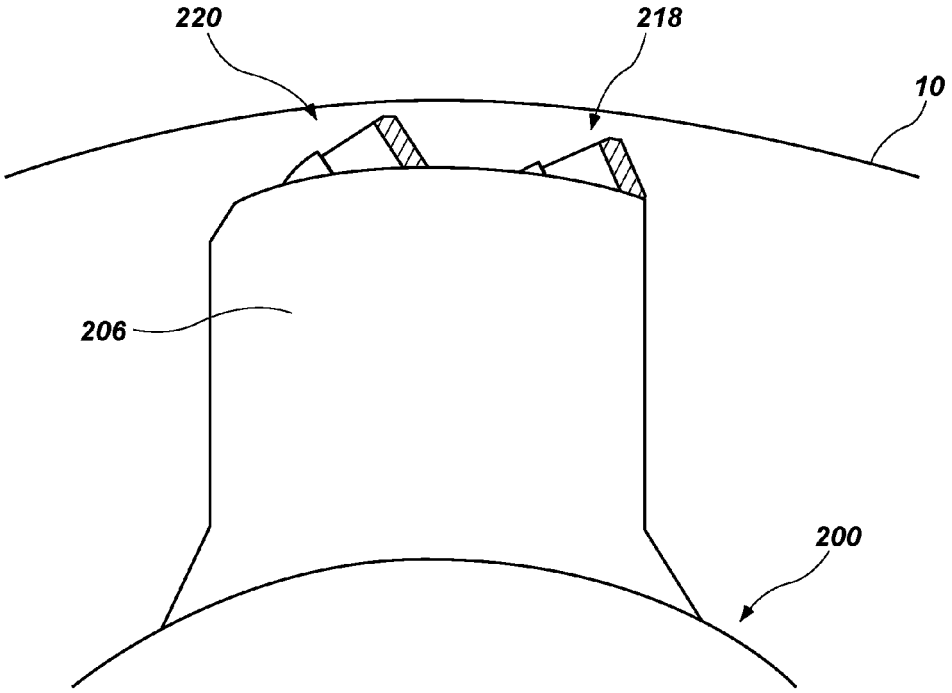
FIG. 8 shows a top view of the cutting structure of FIG. 7 coupled to a downhole tool such as a reamer in accordance with another embodiment of the present disclosure.

FIG. 8 shows a top view of the cutting structure of FIG. 7 coupled to a downhole tool such as a reamer 200. As shown in FIG. 8, cutting elements 220 have an exposure greater than an exposure of the cutting elements 218. In other words, cutting elements 220 extend relatively further from the surface of the blade 206 on which they are mounted than cutting elements 218. The relatively greater exposures of the cutting elements 220 will act to engage the cutting elements 220 with a subterranean formation 10 before the cutting elements 218 engage with the formation 10. In other words, cutting elements 220 will operate as relatively more aggressive, primary cutters and cutting elements 218 will operate as secondary cutters.

Figure 9:
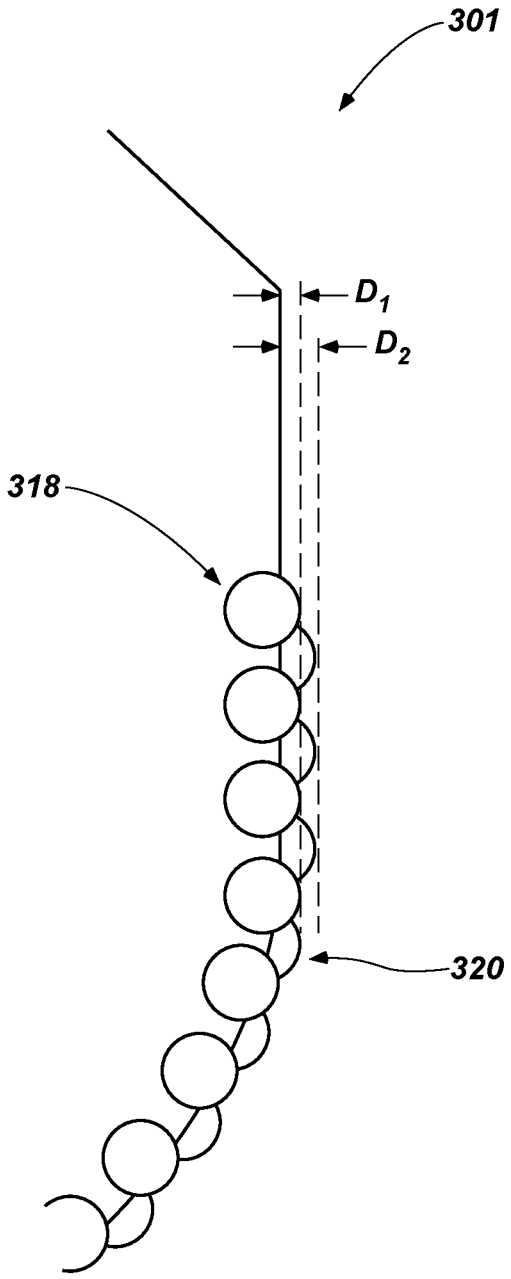
FIG. 9 shows a partial, side view of a cutting structure in accordance with yet another embodiment of the present disclosure.

FIG. 9 shows a partial, side view of a cutting structure 301 that may be somewhat similar to the cutting structures 101, 201 discussed above. As shown in FIG. 9, primary cutting elements 320 have an exposure $D_2$ that is greater than an exposure $D_1$ of the secondary elements 318. As discussed above, the secondary elements 318 may comprise cutting elements, shaped inserts (e.g., ovoids) formed from superabrasive materials and/or tungsten carbide materials, or combinations thereof.

In some embodiments, the primary cutting elements 320 (also, primary cutting elements 120, 220 (see FIGS. 2, 7, and 8)) may be offset (e.g., laterally offset in a direction substantially transverse to a rotational path of the secondary elements 318) from one or more secondary elements 318 (also, secondary elements 118, 218 (see FIGS. 2, 7, and 8)). For example, one or more of the primary cutting elements 320 may be positioned at a location laterally between two secondary elements 318. In other embodiments, the primary cutting elements 320 may each be positioned substantially within a rotational path of a corresponding secondary element 318 (e.g., directly trailing). For example, the primary cutting elements 320 may each be positioned in a kerf of a corresponding secondary element 318.

FIG. 10 shows a top view of the cutting structure 401 coupled to a downhole tool such as a reamer 400 that may be somewhat similar to the cutting structures 101, 201, 301 discussed above. As shown in FIG. 10, secondary element 418 may rotationally lead cutting elements 420 and may be formed as a wear-resistance surface (e.g., hardfacing) at rotationally leading portions of the blade 406 (e.g., at leading surface 410, radially outward surface 411, or combinations thereof. In such an embodiment, the secondary element 418 may be formed as only a wear-resistance surface or may include additional secondary elements such as, for example, elements 118, 218, 318 discussed above.

Figure 11:
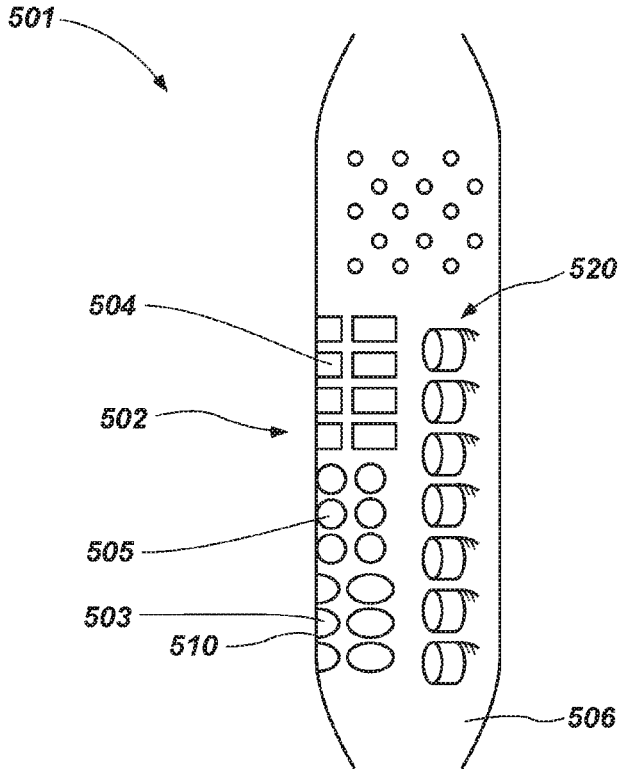
FIG. 11 shows a partial, front view of a cutting structure in accordance with yet another embodiment of the present disclosure.

FIG. 11 shows a partial, front view of a cutting structure 501 that may be somewhat similar to the cutting structures 101, 201, 301, 401 discussed above. The cutting structure 501 includes secondary elements comprising shaped inserts 502. As mentioned above, the shaped inserts may comprise one or more of circular shaped inserts 503 (e.g., ovoids), bricks 504, and discs 505. Such shaped inserts 502 may be formed from one or more of superabrasive materials (e.g., diamond-enhanced materials such as, for example, thermally stable product (TSP) inserts) and tungsten carbide materials. As above, the shaped inserts 502 may rotationally lead cutting elements 520 and may be positioned at rotationally leading portions of blade 506 (e.g., at leading surface 510).

Embodiments of the present disclosure may be particularly useful in providing a cutting structure that is relatively more robust in handling drilling and/or reaming dysfunctions during downhole operations (e.g., vibrations caused by operations including a reamer following a pilot bit). For example, referring back to FIGS. 7 and 8, positioning the primary cutting elements 220 proximate the centerline $C_L$ of the blade 206 may alter the pivot point of the blade 206. As discussed above, additional elements (e.g., one or more rubbing, bearing, or cutting elements such as cutting elements 218) at the rotationally leading surface 210 of the blade 206 may be formed to act as a dampening or rocking feature to be the second point of contact rather the subsequent blade (see, e.g., FIG. 2).

Cutting structures having primary cutting elements positioned at the rotationally leading surface thereof may, during a dysfunction, cause the primary cutting elements at the leading surface to become lodged in the formation material of the borehole wall, causing the downhole tool (e.g., reamer) to experience forward whirl. In other words, the drill string to which the reamer is attached continues to rotate while one or more cutting structures of the reamer are lodged in the formation (i.e., the reamer is not rotating or rotating at a slower rotational speed than the drill string) causing a rotational force (e.g., a reactive moment in a direction opposite to the direction of rotation of the drill string) to build in the drill string. Such a force will generally cause the reamer to pivot on the primary cutting element engaged with the formation causing one or more adjacent cutting structures of the reamer to be forced into the formation, potentially damaging the blade and the cutting elements thereon.

Embodiments of the present disclosure including primary cutting elements positioned away from the rotationally leading edge of the blade may form a pivot point proximate the centerline of the blade (i.e., a pivot point rotationally spaced from the leading edge of the blades). During a dysfunction, the reamer may pivot under a rotation force. However, the primary cutting elements positioned proximate the centerline or trailing surface of the blade may act to pivot the reamer such that the rotationally leading portion of the blade, including additional elements thereon to protect the blade and reamer, may be forced into the formation. Such positioning of a pivot point on the blade and additional, secondary elements at the rotationally leading surface of the blade may reduce the potential damage caused to adjacent cutting structures as compared to cutting structures with primary cutting elements at the leading portion thereof.

While particular embodiments of the disclosure have been shown and described, numerous variations and other embodiments will occur to those skilled in the art. Accordingly, it is intended that the disclosure only be limited in terms of the appended claims and their legal equivalents.

What is claimed is:

1. A reamer for use in a subterranean borehole comprising:

a reamer body; and blades coupled to and configured to radially extend from the reamer body, at least one blade of the blades comprising:

a centerline;

a rotationally leading portion extending from a leading edge of the at least one blade to the centerline;

a rotationally trailing portion extending from the centerline to a trailing edge of the at least one blade;

cutting elements coupled to the at least one blade, each comprising a polycrystalline diamond compact having a substantially planar cutting face configured to engage and remove material from the subterranean borehole, wherein each of the cutting elements is positioned in a single row located between the centerline and the trailing edge of the at least one blade, an entire surface between the leading edge of the at least one blade and the single row of the cutting elements being entirely free of the cutting elements; and a plurality of non-cutting rubbing surfaces rotationally leading the single row of the cutting elements in a direction of intended rotation of the reamer, each of the plurality of non-cutting rubbing surfaces coupled to the at least one blade in a single row located at the leading edge of the at least one blade, the plurality of non-cutting rubbing surfaces positioned and oriented on the at least one blade as a rubbing surface configured to protect the rotationally leading portion of the at least one blade, an entire surface between the trailing edge of the at least one blade and the single row of the cutting elements being entirely free of any cutting elements and the plurality of non-cutting rubbing surfaces, and an entire surface of the at least one blade extending from the single row of the plurality of non-cutting rubbing surfaces to the single row of the cutting elements being entirely free of any cutting elements and the plurality of non-cutting rubbing surfaces, wherein an exposure of each of the cutting elements is greater than an exposure of the plurality of non-cutting rubbing surfaces, the cutting elements primarily configured to engage and remove material from the subterranean borehole, and the plurality of non-cutting rubbing surfaces configured to protect the rotationally leading portion of the at least one blade.

2. The reamer of claim 1, wherein at least some of the cutting elements are positioned and configured on the at least one blade to engage and remove material from the subterranean borehole while the plurality of non-cutting rubbing surfaces moves along the subterranean borehole while stabilizing the at least one blade.

3. The reamer of claim 1, wherein a back rake angle of each of the cutting elements is less than a back rake angle of the plurality of non-cutting rubbing surfaces.

4. The reamer of claim 3, wherein the rubbing surface of the plurality of non-cutting rubbing surfaces is substantially flush with at least one outermost surface of the at least one blade.

5. The reamer of claim 4, wherein the plurality of non-cutting rubbing surfaces comprises a hardfacing material formed on a portion of a body of the at least one blade.

6. The reamer of claim 4, wherein the rubbing surface of the plurality of non-cutting rubbing surfaces is entirely flush with the at least one outermost surface of the at least one blade.

7. The reamer of claim 4, wherein the cutting elements extend relatively farther from the at least one outermost surface of the at least one blade than the plurality of non-cutting rubbing surfaces.

8. The reamer of claim 3, wherein the rubbing surface of the plurality of non-cutting rubbing surfaces is positioned to extend in a direction substantially parallel to a portion of at least one outermost surface of the at least one blade.

9. The reamer of claim 1, wherein the plurality of non-cutting rubbing surfaces comprises at least one of a diamond-enhanced material or a material comprising tungsten carbide.

10. The reamer of claim 1, wherein the plurality of non-cutting rubbing surfaces is laterally offset from each of the cutting elements in a direction transverse to the direction of intended rotation of the reamer.

11. A reamer for use in a subterranean borehole comprising:

a reamer body; and at least one blade positioned on and configured to radially extend from the reamer body, the at least one blade comprising:

a plurality of cutting elements coupled to the at least one blade and extending along the at least one blade in a direction substantially parallel to a centerline of the at least one blade, wherein each of the plurality of cutting elements is positioned in a single row located proximate the centerline of the at least one blade, and wherein a leading surface of the at least one blade is entirely free of the plurality of cutting elements; and a plurality of non-cutting rubbing surfaces coupled to the at least one blade in a single row proximate the leading surface of the at least one blade and rotationally leading the plurality of cutting elements, wherein an exposure of each of the plurality of cutting elements is greater than an exposure of the plurality of non-cutting rubbing surfaces, and wherein a portion of the plurality of non-cutting rubbing surfaces is positioned substantially flush with at least one of a radially outermost surface of the at least one blade or the leading surface of the at least one blade, an entire trailing portion rotationally following the plurality of cutting elements proximate the centerline of the at least one blade lacking cutting elements and the plurality of non-cutting rubbing surfaces, and an entire surface of the at least one blade extending from the single row of the plurality of non-cutting rubbing surfaces to the single row of the cutting elements lacking cutting elements and the plurality of non-cutting rubbing surfaces.

12. A method for enlarging a subterranean borehole, the method comprising:

engaging a subterranean borehole with at least one reamer blade coupled to and configured to radially extend from a body of a reamer;

reaming a portion of the subterranean borehole with a plurality of cutting elements, wherein each of the plurality of cutting elements is positioned in a single row located between a centerline and a trailing edge of the at least one reamer blade, an entire surface of the at least one reamer blade between a leading edge of the at least one reamer blade and the single row of the plurality of cutting elements being entirely free of the plurality of cutting elements; and at least partially protecting a leading surface of the at least one reamer blade from wearing against the subterranean borehole with a plurality of non-cutting rubbing surfaces positioned in a single row at the leading edge of the at least one reamer blade, a trailing portion of the at least one reamer blade configured to rotationally follow the plurality of cutting elements being free of any cutting elements and the plurality of non-cutting rubbing surfaces, an entire surface of the at least one reamer blade extending from the single row of the plurality of non-cutting rubbing surfaces to the single row of the cutting elements being entirely free of any cutting elements and the plurality of non-cutting rubbing surfaces, and an exposure of the plurality of non-cutting rubbing surfaces being less than an exposure of each of the plurality of cutting elements.

13. The method of claim 12, further comprising selecting a material of the plurality of non-cutting rubbing surfaces for wear-resistance.

* * * * *